US005322202A

United States Patent [19]

Pelletier

[11] Patent Number: 5,322,202

[45] Date of Patent: Jun. 21, 1994

[54] LABEL PRESSING APPARATUS

[75] Inventor: Gilles Pelletier, Charlotte, N.C.

[73] Assignee: J. R. Cole Industries, Inc., Charlotte, N.C.

[21] Appl. No.: 891,222

[22] Filed: May 29, 1992

[51] Int. Cl.[5] ..... B65H 35/10

[52] U.S. Cl. ..... 225/97; 83/103; 225/104; 493/342; 493/373

[58] Field of Search ..... 225/104, 1, 127, 2, 225/97; 83/103, 29, 86, 97, 639.5; 493/342, 373

[56] References Cited

U.S. PATENT DOCUMENTS

| | | | |
|---|---|---|---|
| 2,667,922 | 2/1954 | Hill et al. | 83/639.5 |
| 4,015,495 | 4/1977 | Yerly | 493/342 X |
| 4,730,761 | 3/1988 | Spano | 225/2 |
| 4,921,154 | 5/1990 | Abe et al. | 225/97 |
| 5,087,236 | 2/1992 | Morimoto | 493/342 |
| 5,101,747 | 4/1992 | Gerber | 83/103 X |

*Primary Examiner*—Richard K. Seidel
*Assistant Examiner*—Kenneth E. Peterson
*Attorney, Agent, or Firm*—Shefte, Pinckney & Sawyer

[57] ABSTRACT

An apparatus and method for removing a plurality of printed labels configured as paper sheet portions from a plurality of stacked pressing sheets, the labels being partially precut and arranged in a predetermined pattern in the pressing sheets, including a die plate having a plurality of openings formed therein in a predetermined pattern corresponding to the pattern of the labels in the pressing sheets. The labels are pressed from the pressing sheets through the openings by a plurality of press members which are arranged in a predetermined pattern corresponding to the patterns of both the labels and the die openings, and project from a vertically movable press plate. As the labels are pressed from the master sheets, the die plate openings help to maintain the labels in aligned stacks.

2 Claims, 8 Drawing Sheets

LABEL PRESSING APPARATUS

BACKGROUND OF THE INVENTION

The present invention relates to the separation of a plurality of labels, or other indicia bearing sheet portions, from a master pressing sheet and more particularly to an apparatus for separating labels, cards or the like from a plurality of pressing sheets arranged in stacked alignment.

Certain packaged products, such as cassette tapes or computer diskettes, are packaged with indicia bearing label stock to convey information about the cassette or computer diskette. In the case of cassettes, labels are generally rectangular card stock having information about the cassette printed thereon wherein the card stock will fit within a plastic compact cassette case which is typically clear as is well known. In addition, computer diskettes are typically packaged with a fiber sheeting sleeve, typically formed of TYVEK® fiber sheeting material, which is a product of E.I. DuPont deNemours & Co. of Wilmington, Del. The sleeves are sheet portions that are folded and glued flat to provide the container for the computer diskette. As is the case with cassette tapes, indicia concerning the computer diskette is printed on the sleeve. These labels, or indicia bearing sheet portions, are typically printed in an array on one large master sheet. A typical master sheet, known as a "pressing sheet," will have an array of identical labels arranged in rows and columns. Generally, a stack of pressing sheets eight inches thick will contain about one thousand pressing sheets.

Generally, once the labels are printed on the master pressing sheets, a partial cut will be made around the perimeters of the labels leaving a small portion of the label attached to the pressing sheet such that when the separation of the labels is necessary, they can be punched from the sheet leaving a smooth edge except for a slight rough portion where the attachment to the master pressing sheet occurred. The portion of the master sheet remaining after the sheet portions are separated or removed is known as a "skeleton."

Prior to shipping the labels to the cassette or computer diskette manufacturers, the printer will remove the labels from the master pressing sheets and box the resultant stacks of labels for shipment. Accordingly, the task of removing the labels from the pressing sheet typically falls to the printer. Conventionally, the labels are removed individually by hand, each label being pressed from the master sheet by a print shop worker who stacks the individual labels in a box. As the quantity of labels increases, the removal and stacking of the printed labels becomes an increasingly tedious task and slows down the manufacturing process. Further, such repetitious hand movements as are required to remove the labels from the pressing sheets may lead to what is known as carpal tunnel syndrome which can result in workers losing the use of their hands.

Accordingly, there is a need for an improved method of removing printed cassette type labels, computer diskette sleeves and other indicia bearing sheet portions from their master pressing sheets in order to remove unnecessary delays from the manufacturing process as well as removing a source of the risk of carpal tunnel syndrome from the workers.

SUMMARY OF THE INVENTION

It is accordingly an object of the present invention to provide an apparatus and method for removing a plurality of printed labels configured as paper sheet portions from a plurality of stacked master pressing sheets that solves the aforementioned problems.

According to the present invention, an apparatus for removing a plurality of paper sheet portions from a plurality of pressing sheets, the sheet portions being arranged in a predetermined pattern in the pressing sheets, includes an arrangement for pressing the sheet portions from the pressing sheets, an arrangement for receiving and aligning the plurality of sheet portions pressed from the pressing sheets, the pressed sheet portions being directed into a receiving area, and an assembly for removing the aligned plurality of sheet portions from the receiving area. Preferably, the arrangement for pressing the sheet portions from the pressing sheets includes a press plate slidably mounted in a frame and having a plurality of press members for pressing the sheet portions and removing them from the pressing sheets.

The press members project from the press plate and are arranged in a predetermined pattern corresponding generally to the predetermined pattern of the sheet portions in the pressing sheets. Further, the arrangement for receiving and aligning the sheet portions pressed from the pressing sheets includes a die plate mounted to the frame in a spaced relation with the press plate, the die plate having a support surface formed with a plurality of openings therein. The openings are shaped to generally conform to the sheet portions in the pressing sheets, whereby the pressing sheets can be stacked on the support surface intermediate the die plate and the press plate with the sheet portions of each pressing sheet aligned with one another and with the openings, the openings being of a depth at least equal to the height of the stacked pressing sheets.

It is further preferred that the pressing arrangement include an arrangement for moving the press plate along a path of movement between a first position at which the press members are spaced away from the die plate support surface and a second position at which the press members are adjacent the openings formed in the die plate support surface so that when the pressing sheets are positioned on the die plate support surface the moving press members engage the sheet portions for pressing the sheet portions to remove them from the pressing sheets. The sheet portions may be partially precut in the pressing sheets and the press members include a pressing surface for engagement with the sheet portions, the pressing surface generally conforming to the shape of the sheet portions. It is preferred that the removing assembly include a receiving area and conveyor positioned for removing the stacked sheet portions from the receiving area.

In the preferred embodiment of the present invention, the arrangement for moving the press plate includes a piston and cylinder assembly mounted to the frame and to the press plate in an orientation for moving the press plate between its first position and its second position for removing the sheet portions from the pressing sheets. It is preferred that the arrangement for moving the press plate includes a control assembly initiating and terminating the movement.

It is also preferred that the apparatus of the present invention includes a receiving assembly having a receiving plate mounted on the frame spaced from the die plate and positioned for receiving the stacks of aligned sheet portions removed from the pressing sheets by the press members after the sheet portions pass through the openings in the die plate support surface. The receiving plate may be movably mounted to the frame and include an arrangement for moving the receiving plate along a predetermined path between a first position adjacent the die plate for receiving the sheet portions as they are removed from the openings in the die plate support surface and a second position in which the receiving plate is spaced away from the die plate for removal of the sheet portions from the receiving plate, the moving arrangement therefore being mounted to the frame intermediate the receiving plate and the frame.

According to the preferred embodiment of the present invention, the assembly for moving the receiving plate includes a piston and cylinder assembly mounted to the receiving plate and the frame thereby allowing the receiving plate to move along its predetermined path, the movement being initiated by a control arrangement in response to the movement of the press plate. The control arrangement may include a hydraulic sequencing valve for initiating the movement responsive to press plate movement.

According to the method of the present invention a plurality of sheet portions are removed from a plurality of pressing sheets, the sheet portions being arranged in a predetermined pattern in the pressing sheets utilizing the following steps. The plurality of pressing sheets is stacked on a support surface having openings formed therein, the openings generally conforming to the shape of the sheet portions, and the stack of pressing sheets being oriented in a manner wherein the sheet portions in each pressing sheet are positioned in alignment with one another and with the openings. The precut sheet portions are then pressed to remove the sheet portions from the pressing sheets and are then directed into the openings to form a plurality of aligned stacks which pass through the openings to a receiving surface. Additionally, the stacks of sheet portions are received and supported in an aligned condition on the receiving surface.

DESCRIPTION OF THE PREFERRED EMBODIMENT

Figure 1:
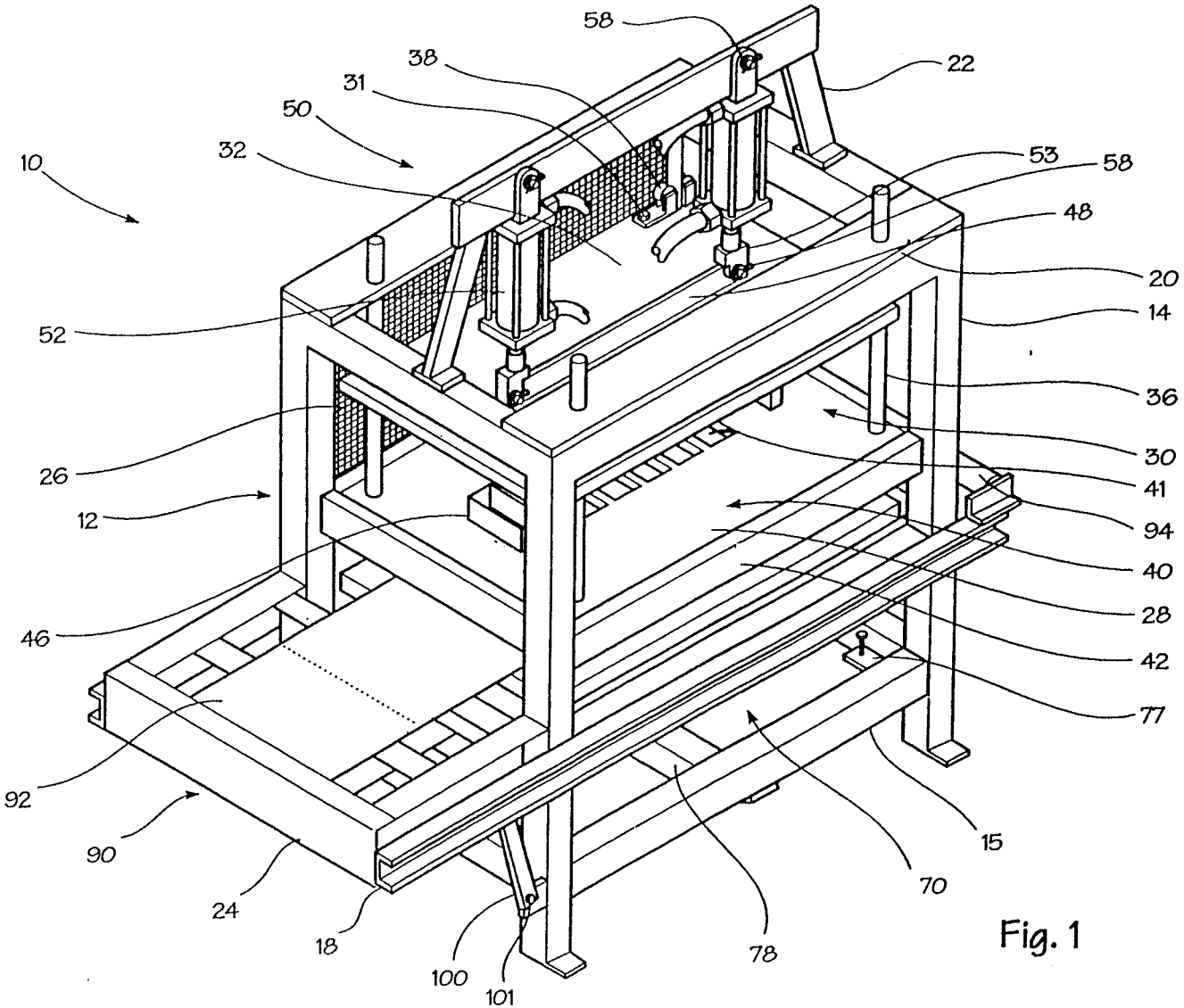
FIG. 1 is a perspective view of the label removal apparatus of the present invention.

Referring now to the drawings, and particularly to FIG. 1, an apparatus for pressing a plurality of sheet portions from a stacked plurality of pressing sheets is shown generally at 10 and includes a rectangular, upstanding frame 12, a press and die assembly 30, a press drive assembly 50, a label receiving assembly 70 and a conveyor assembly 90.

The frame 12 is formed as a floor standing, open rectangular structure including four vertically oriented, upstanding frame members 14 united to form a generally rectangular configuration by four upper cross braces 20 and four lower cross braces 16 which form the perimeter of the frame 12. Intermediate the upper cross braces 20 and the lower cross braces 16, two midline cross braces 18 are mounted to opposite sides of the frame 12 and extend generally horizontally outwardly therefrom along one side thereof. A generally C-shaped auxiliary frame 24 is mounted to the upstanding frame members 14 between the two extended portions of the midline cross braces 18 defining a label removal area and providing a mounting assembly for primary portions of the conveyor assembly 90. An upstanding truss 22 is mounted to two of the upper cross braces 20 to provide a mounting location for two press drive hydraulic motors 52 which will be described in detail hereinafter.

Figure 2:
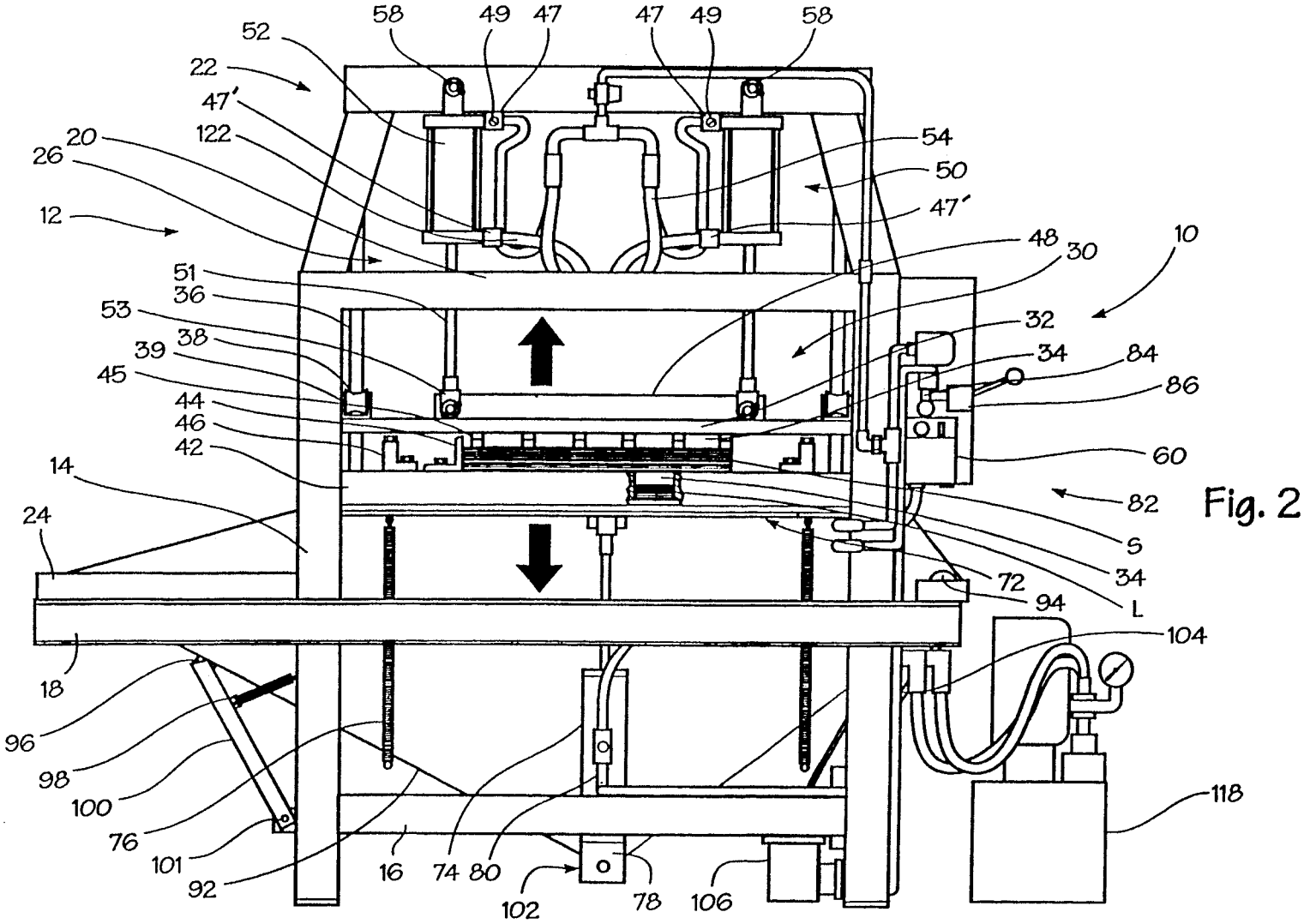
FIG. 2 is a side elevational view of the label removal apparatus illustrated in FIG. 1 with the press plate in a position for pressing a plurality of labels from a plurality of pressing sheets.

With reference to FIG. 2, the press and die assembly 30 is instrumental in the pressing removal of the labels from the pressing sheets S and is confined within the frame 12 to an area intermediate the midline cross braces 18 and the upper cross braces 20, and includes a generally planar, horizontally oriented die plate 40 (see FIG. 1) and a generally planar, horizontally oriented press plate 32 mounted above the die plate 40. Four die plate support members 42 are permanently mounted to the frame 12 intermediate the upper cross braces 20 and the midline cross braces 18, closely adjacent the midline cross braces 18. The die plate support members 42 are generally rectangular beam members having a lip projecting inwardly from the lower surface thereof, and are arranged around all four sides of the frame 12 to form a supporting well in which the die plate 40 rests.

The die plate 40 includes a support surface 28 (see FIG. 1) which supports the pressing sheets for pressing removal of the labels therefrom and contains the aligned stacks of labels L that have been removed from the pressing sheets S as seen in FIG. 2 wherein a die plate support member 42 is illustrated partially in section. The die plate support surface 28 includes a plurality of die openings 41 formed therein. At each corner of the die plate support surface 28, threaded openings (not shown) are provided for attachment of a plurality of alignment rods 36. The alignment rods 36 have threaded end portions which are received in the threaded openings (not shown) in the die plate 40. The alignment rods 36 project upwardly through corresponding holes 37 formed in the press plate 32 and assist in maintaining the alignment of the press plate 32 with the die plate 40.

The plurality of die openings 41 in the die plate 40 receive the labels L as they are removed from the pressing sheets S and form them into aligned stacks within the confines of the die openings 41 in a manner to be described in more detail below.

The die plate 40 is preferably formed of a single piece of metal, with the die openings 41 being cut thereinto using a laser, and is of sufficient thickness that when the labels L are pressed from the pressing sheets S, the die openings 41 maintain the labels L in a stacked aligned relation as they are positioned on the receiving platform. Corresponding in size and arrangement to the labels in the pressing sheets, the die openings 41 are arranged generally in the center of the die plate support surface 28.

A safety screen 26 is mounted to two of the upstanding frame members 14 on one side of the frame 12 to block access to the area intermediate the press plate 32 and the die plate 40 from the side of the frame 12 which is not used for loading pressing sheets S. An additional safety screen, not shown in the drawings for clarity, may be pivotably attached to the frame 12 to cover the loading access area.

Referring again to FIG. 2, two L-shaped stack alignment members 44, 45 are arranged perpendicularly to one another along two sides of the perimeter of the arrangement of die openings 41 to align the stacks of pressing surfaces by providing abutment surfaces at the edges of the stacked pressing sheets stacked on the die plate support surface 28 for pressing removal of the labels L therefrom. Threaded openings (not shown) are provided for bolting the alignment members 44, 45 to the die plate 40.

Figure 3:
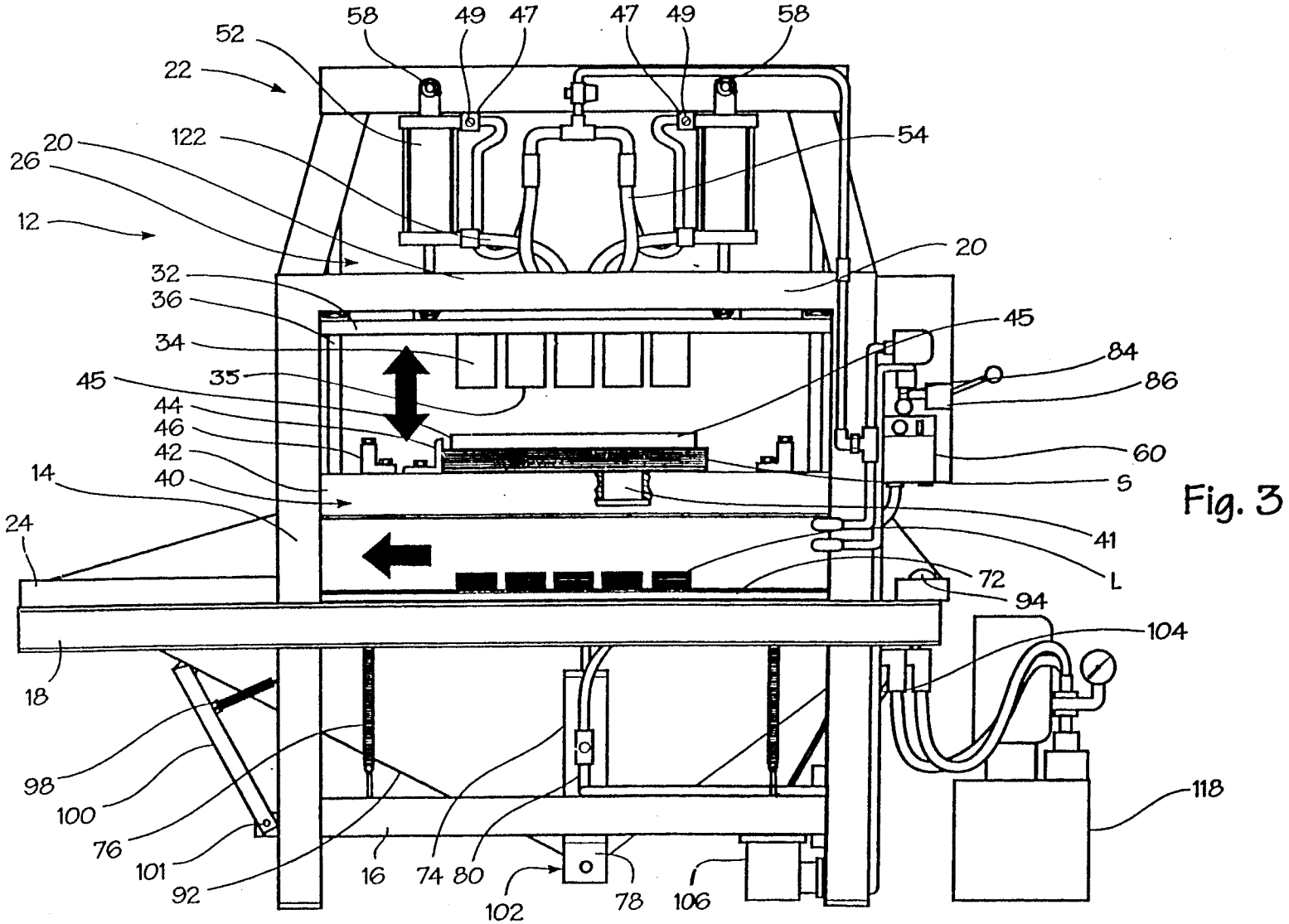
FIG. 3 is a side elevational view of the label removal apparatus illustrated in FIG. 1 showing the position of the press plate after the labels have been removed from the pressing sheets.

With reference to FIG. 3, two generally rectangular stop members 46 are bolted to the die plate support surface 28 intermediate the die openings 41 and the edge of the die plate 40 using threaded openings formed in the die plate 40. The generally upright rectangular stop members 46 are provided as a safety feature to prevent the press plate 32 from crushing anything caught between the press plate 32 and the die plate 40 should the press plate 32 break free from its mounts and drop onto the die plate 40.

The press plate 32 is used to press the labels from the pressing sheets and through the die openings 41 to provide aligned stacks of labels, and it is a planar, generally horizontally oriented plate, having a plurality of press members 34 projecting downwardly from the lower surface thereof in the general direction of the die plate 40. The press members 34 are generally rectangular, elongate members formed with a pressing surface 35 having a shape corresponding to the shape of the labels for which they are intended to press, and arranged in a predetermined pattern to conform to the predetermined pattern of the die openings 41. As is evident, the predetermined pattern of the press members 34 and the die openings 41 conform to the predetermined pattern of the labels L in the pressing sheets S. As will be explained hereinafter, the configuration of the apparatus 10 may be altered by interchanging different press and die assemblies 30 to accommodate various label configurations.

Figure 4:
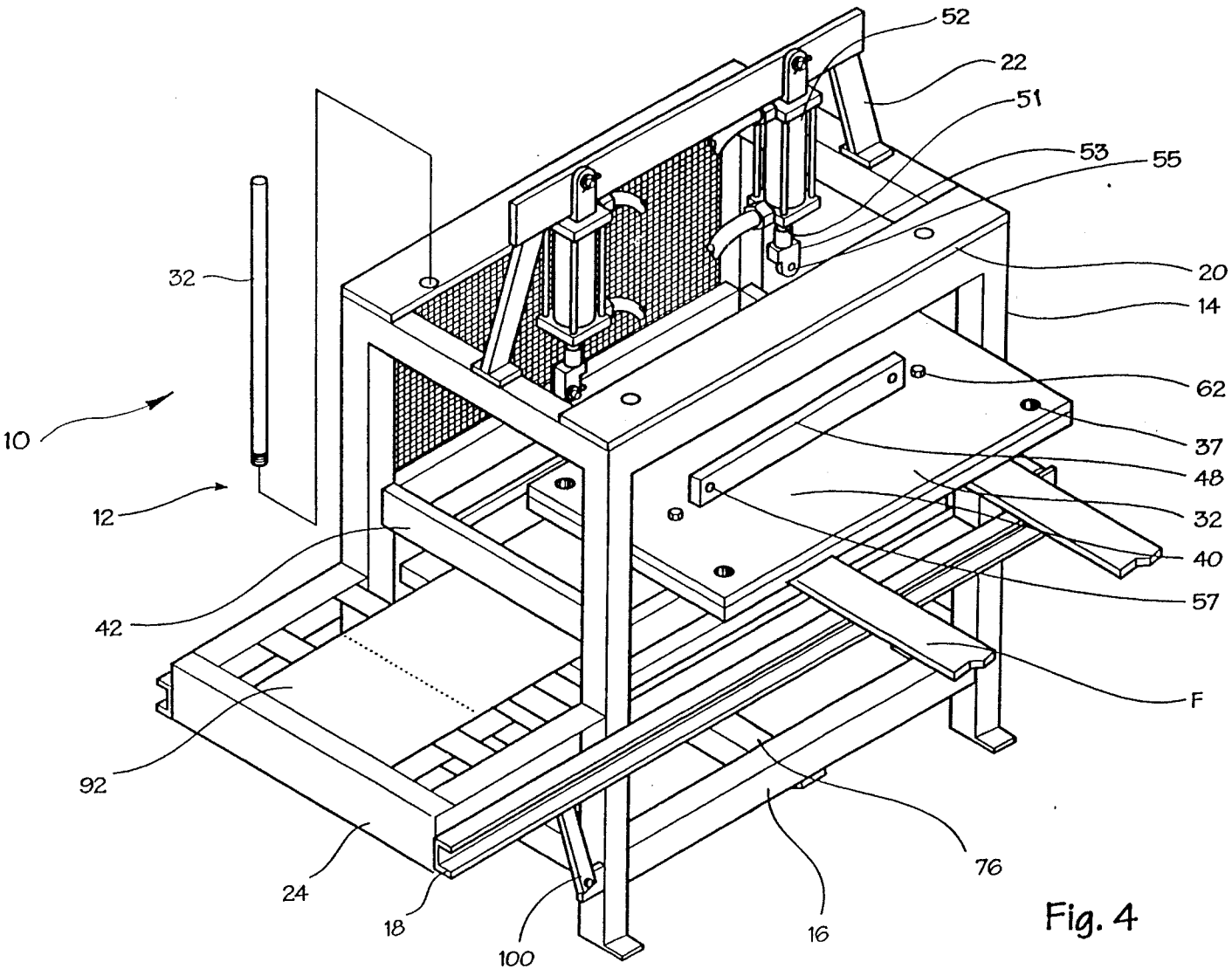
FIG. 4 is a detail perspective view of the label removal apparatus of the present invention illustrating the removal of the press and die assembly.

As previously mentioned and as best seen in FIG. 4, openings 37 are formed at all four corners of the press plate 32 to accommodate the alignment rods 36. Referring now to FIG. 2, adjustment rollers 38 are mounted to the upper surface of the press plate 32 adjacent the openings 37 provided for the alignment rods 36. The adjustment rollers 38 are pairs of spool-like rollers which are slidably mounted oppositely to each other closely adjacent the openings 37 in the press plate 32 to be in rolling contact with the alignment rods 36. Mounting platforms 39 are provided for slidably mounting the adjustment rollers 38 to the upper surface of the press plate 32. The adjustment rollers 38 provide an adjustment for aligning the press members 34 with the die openings 41.

As was also previously mentioned, the alignment rods 36 are threadably attached to the die plate 40 at all four corners thereof and extend vertically therefrom, passing through corresponding openings 37 in the press plate 32. A generally rectangular, upstanding, elongate piston rod mounting bar 48 is mounted to the upper surface of the press plate 32.

The press plate drive assembly 50 provides the driving force to press the labels L from the pressing sheets S and includes two hydraulically operated motors 52 which are suspended vertically from the support truss 22 located at the top portion of the frame 12 with their associated piston rods 51 mounted to the piston rod mounting bar 48 by C-shaped attachment members 53 which are configured to fit over the rectangular piston rod mounting bar 48. As best seen in FIG. 4, holes 55, 57 are formed in both the C-shaped attachment members 53 and the piston rod mounting bar 48 such that when the C-shaped attachment members 53 are fitted over the mounting bar 48, the holes are in alignment and a conventional rod and pin assembly 58 (see FIG. 1) is used to secure the C-shaped attachment members 53 to the mounting bar 48.

With reference to FIG. 2, the hydraulic motors 52 are operated by pressurized hydraulic fluid provided through hydraulic lines 54 from a central hydraulic pump 118. The hydraulic motors 52 each include two hydraulic fluid inlets 47, 47', an upper inlet 47 providing fluid for lowering the press plate 32 and a lower inlet 47' providing fluid for raising the press plate 32. Flow regulators 49 are provided at each upper hydraulic inlet 47 for individually regulating the flow of hydraulic fluid to each hydraulic motor 52. Adjustment of the flow regulators 49 allows the operator to compensate for individual differences which may be present in the hydraulic motors 52 which aids in maintaining even, level pressing movement of the press plate 32. As will be explained in greater detail hereinafter and with reference to FIG. 7, the hydraulic pump 118 controls all pressing operations through a hydraulic sequencing system 110.

With reference to FIG. 3, the label receiving assembly 70 receives aligned stacks of labels L which pass through the die openings 41 and positions the removed labels for subsequent removal from the apparatus 10. The label receiving assembly 70 includes a label receiving platform 72 movably mounted to the frame 12 adjacent the midline cross braces 18 and below the die plate 40 in a spaced vertical relation therewith. The receiving platform 72 is movably supported by a single hydraulic motor 74 mounted to the frame 12 using a lower central cross member 78 which traverses the lowermost portion of the frame 12 near the center thereof and is mounted to and between two oppositely facing lower cross braces 16. Four stabilizing springs 76 are mounted at all four corners of the lower surface of the receiving platform 72 and to mounting platforms 77 (see FIG. 1) which are mounted to the frame 12 below the receiving platform 72 and at the junction of the lower cross braces 16 with the upstanding frame members 14, as best seen in FIG. 2. When the receiving platform 72 is raised, the stabilizing springs 76 resist the upward movement and are extended. The downwardly directed force of the stabilizing springs 76 at the corners of the platform 72 tends to reduce rotational movement of the platform 72 and keeps the platform 72 generally firmly in a stable orientation during movement thereof.

Movement of the receiving platform 72 is controlled by the aforementioned hydraulic pump 118 and the hydraulic sequencing system 110 (see FIG. 7) which will be explained in greater detail hereinafter. Hydraulic lines 80 are provided for fluid transmission between the pump 118 and the hydraulic motor 74.

Referring to FIG. 1, the conveyor assembly 90 is used to move stacks of labels L removed from the pressing sheets S from the receiving platform 72 out onto the auxiliary frame 24 so that the operator can transport the labels L from the apparatus 10. The conveyor assembly 90 includes a conventional conveyor belt 92 following an endless path over the receiving platform 72 out onto the auxiliary frame 24, down under the receiving platform hydraulic motor 74 and back on to the receiving platform 72 (see FIGS. 1 and 2).

With reference to FIG. 2, the conveyor belt 92 is driven by a conventional electric motor 106 mounted to the lowermost portion of the frame 12 which drives the conveyor belt 92 using a conventional drive chain 104. A guide roller 102 is mounted to the lower central cross member 78 to facilitate conveyor belt 92 motion. Rollers 94 are mounted at each end of the midline cross braces 18 to provide support for the conveyor belt 92 while allowing operational movement thereof.

Since the conveyor belt 92 is located intermediate the receiving platform 72 and the die plate 40, it must rise and return in a movement coordinated with the movement of the receiving platform 72. Accordingly, the belt 92 must contain sufficient excess material to accommodate the vertical travel distance of the receiving platform 72. However, since the belt 92 must be movable when the receiving platform is in its lowermost position, sufficient tension must be maintained on the belt 92 to account for the extra material. A tension roller 96 is provided for this purpose and it includes an elongate tension roller support member 100 pivotably mounted to frame members 14 below the auxiliary frame 24.

The tension roller 96 is mounted to the free end of the roller support member 100 and is maintained in contact with the belt 92 by springs 98 mounted to both the tension roller support member 100 and the upstanding frame members 14, the frame mounting position being disposed a distance up the frame 12 from the pivot 101 of the tension roller support member 100. The springs 98 maintain continuous contact between the tension roller 96 and the conveyor belt 92 during operation of the tension roller mechanism which will be explained in greater detail hereinafter.

As previously mentioned, the press plate 32 is provided with an alignment adjustment. Adjustment of the press plate alignment is accomplished by lowering the press plate 32 so that the press members 34 begin to enter the die openings 41. With the bolts 31 mounting the adjustment roller platform 39 to the press plate 32 loosened, the press plate 32 is manually aligned so that the press members 34 are properly aligned with the die openings 41. The adjustment rollers 38 are then slid into contact with the alignment rods 36, and the platform bolts 31 are retightened. This adjustment prevents binding of the labels L during the pressing operation which could result if the labels were pressed angularly into the die openings 41 as would likely occur should the press plate become misaligned. Additional press plate 32 adjustment is accomplished by regulating the flow to each of the hydraulic motors 52 until the press plate 32 is driven downwardly in a horizontal orientation, with each hydraulic motor 52 providing an equal contribution to the driving motion.

Operation of the apparatus 10 is controlled from the operator controlling station 82 (see FIG. 2). The movement of the press plate 32 and the receiving platform 72 are automatically controlled by the hydraulic sequencing system 110 (see FIG. 7) while the conveyor belt 92 is independently controlled using a conventional motor controller 60.

Figure 7:
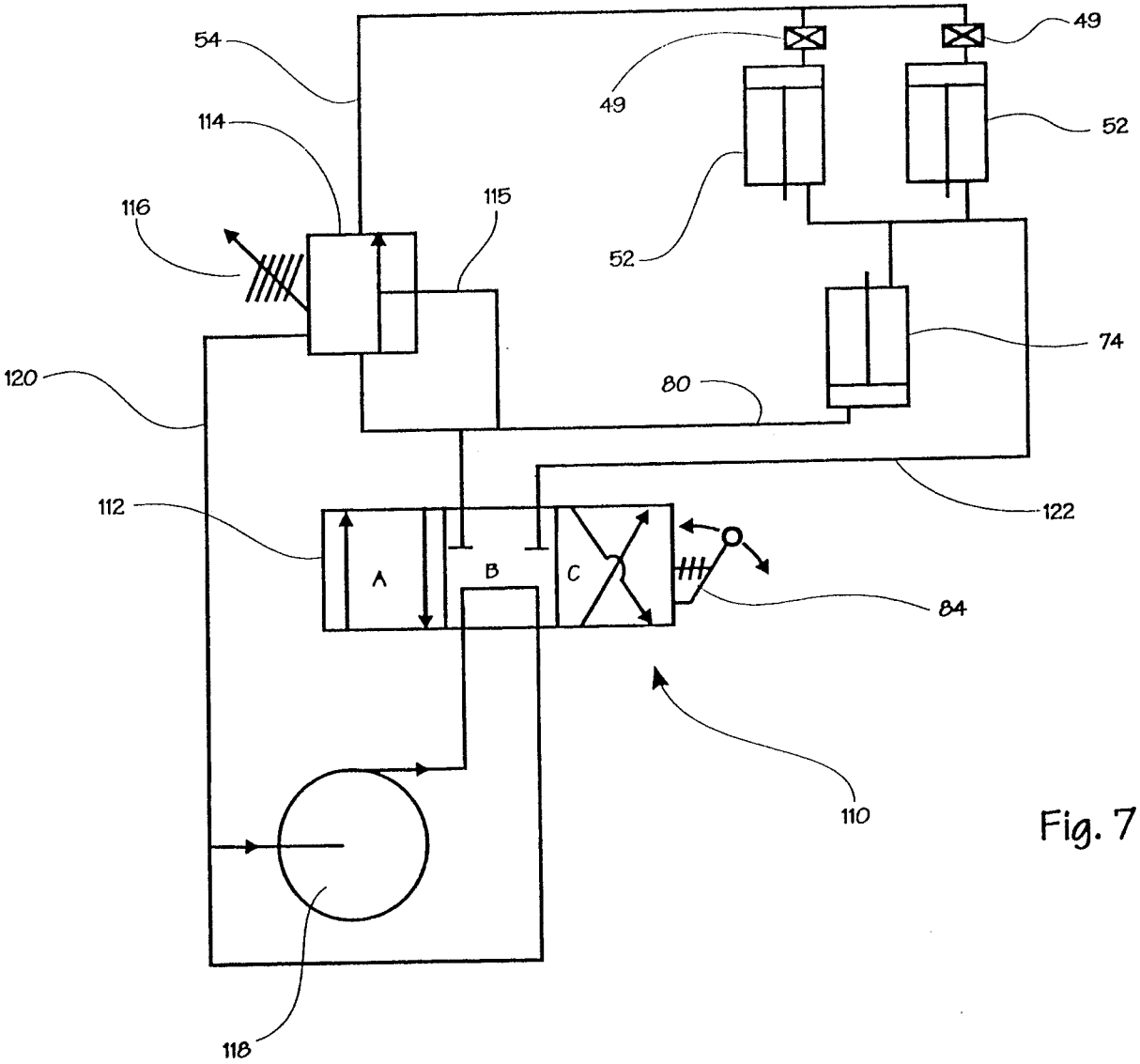
FIG. 7 is a diagrammatic illustration of the hydraulic control system of the label removal apparatus of the present invention.

Referring to FIG. 7, the hydraulic sequencing system 110 provides control of the movement of the press plate 32 and the receiving platform 72 (see FIG. 3) and includes the hydraulic pump 118, a master control valve 112 and a sequencing valve 114, all connected to the hydraulic motors 52, 74 by conventional hydraulic lines 54, 80, 122. A safety switch 86 (see FIG. 2) is provided at the operator control station 82 for prevention of accidental initiation of press plate 32 or receiving platform 72 movement. The safety switch 86 must be actively disengaged during all press plate 32 and receiving platform 72 movement, thus requiring two hands to operate the apparatus 10. As will be explained in greater detail presently, by using the master control valve 112, the operator of the apparatus 10 controls the sequence of press plate 32 and receiving platform 72 movements necessary for label removal.

The sequencing valve 114 is a normally closed gate valve which is pressure operated. Pressure within the hydraulic line 80 which feeds the lower hydraulic motor 74 is sensed through a pressure response line 115 causing the sequencing valve 114 to open at a predetermined pressure. The predetermined response pressure may be manually adjusted using an adjustment assembly 116 provided at the valve 114. Additionally, return line 120 provides overpressure relief when the hydraulic pressure is at a maximum in all three hydraulic motors 52, 74, the occurrence of which will be explained presently.

Figure 5:
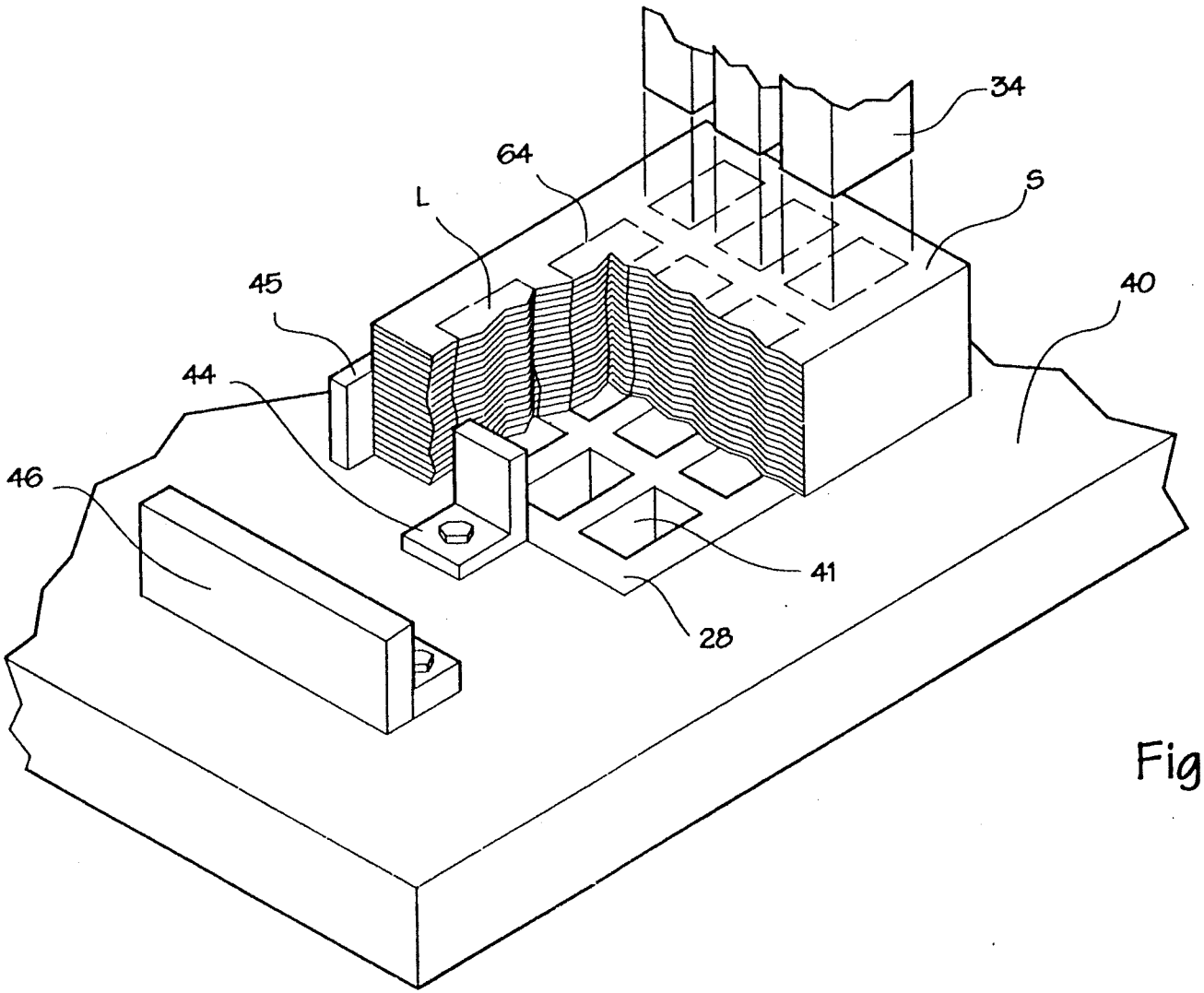
FIG. 5 is a perspective view of the support surface of the label removal apparatus of the present invention illustrating the relationship among the labels in a stack of pressing sheets, the die openings and the press members.

Operation of the apparatus is generally as follows. With reference to FIG. 5, a plurality of pressing sheets S having an array of labels L printed thereon is provided with the labels L partially precut in the pressing sheets S leaving a series of small attachment points 64 which retain the labels L in the pressing sheets S until they are forcibly removed, either by the known method of removing the labels L by hand or by use of the apparatus 10 of the present invention. Initially, a plurality of pressing sheets S is stacked on the die plate support surface 28 in abutting relation with the alignment members 44, 45 such that the label portions of the pressing sheets S are aligned with the openings 41 in the die plate 40. A generally flat receiving and removal board (not shown), which may be a simple sheet of plywood is placed on the receiving platform 72 directly beneath the die openings 41.

With reference to FIGS. 2 and 7, once the pressing sheets S are in place, the operator releases and holds open the safety switch 86 which allows operation of the master control valve 112 which, in turn, operates the hydraulic sequencing system 110. The master control valve 112 has three possible positions. Position B is the normal "off" position when the apparatus 10 is inactive.

Positions "A" and "C" are operational positions which will be explained presently.

In order to initiate operation, the master control handle 84 is operated to initially align the valve to position A which routes hydraulic fluid through the hydraulic lines 80 to the hydraulic motor 74 controlling the movement of the receiving platform 72. The receiving platform 72 is caused to be raised by the hydraulic motor 74 to a position directly beneath and closely adjacent the die plate 40 for receiving the labels to be pressed from the pressing sheets S. While the receiving platform 72 is being driven upwardly by its hydraulic motor 74, the pressure activated sequencing valve 114 remains closed, blocking hydraulic fluid flow to the hydraulic motors 52 which control the movement of the press plate 32.

When the receiving platform 72 reaches its uppermost position, the sequencing valve 114 senses the increased pressure in the hydraulic line 80 resulting from the impeded movement of the receiving platform 72. Responsive to this increased pressure, the sequencing valve 114 opens, allowing hydraulic fluid to flow to the hydraulic motors 52 which drive the press plate 32. When hydraulic fluid is applied, the press plate 32 is driven downwardly by the hydraulic motors 52 toward the die plate 40, and is maintained in alignment by the adjustment rollers 38 in contact with the alignment rods 36. The pressing surfaces 35 of the press members 34 make contact with the labels within the top pressing sheet S and the driving motion continues until all labels L are pressed free from the pressing sheets S as seen in FIG. 2.

Figure 6:
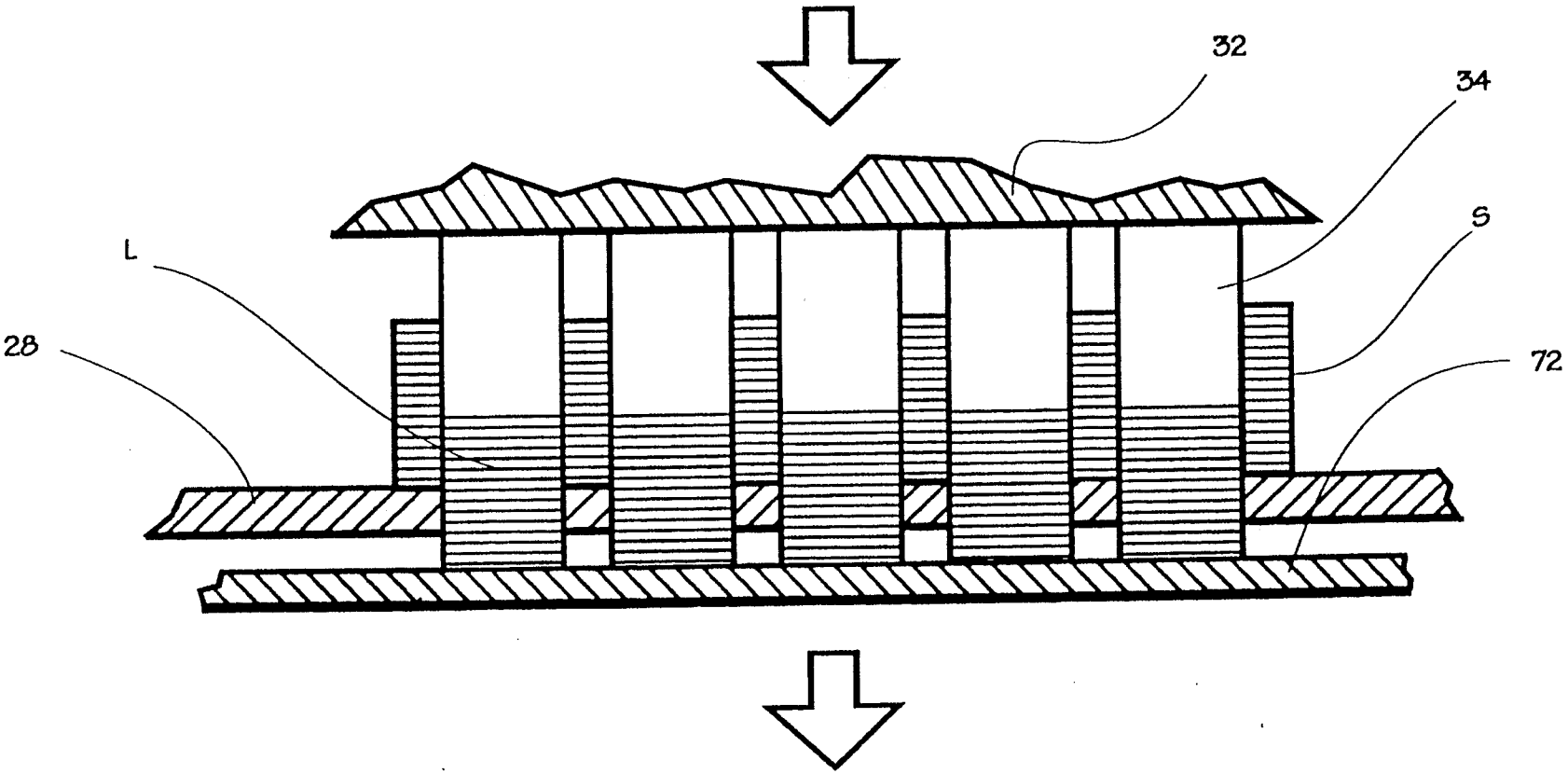
FIG. 6 is a cross-sectional side view of the press and die assembly of the label removal apparatus of the present invention illustrating the removal of aligned stacks of labels from a stack of pressing sheets.

Referring now to FIG. 6, when the labels L are pressed from the pressing sheets S they are directed into the die openings 41 which maintain the labels L in an aligned stacked relation as they are deposited onto the receiving platform 72. After the initial contact of the label stack with the receiving platform 72, the press plate 32 is still being driven downwardly, pressing more labels L from the lower pressing sheets. To prevent crushing the labels, the receiving platform 72 is caused to begin its descent prior to the reversal of press plate 32 movement. As the labels L are pressed downwardly, they exert an increasing pressure on the receiving platform 72 which in turn exerts a downward force on the hydraulic motor 74. As a result, an increased pressure is realized through hydraulic line 80 and is transmitted to the sequencing valve 114 by the pressure response line 115 (see FIG. 7). Accordingly, this excess pressure is relieved by allowing a portion of the hydraulic fluid applied to the hydraulic motor 74 to return to the pump through the return line 120. This allows the press plate 32 and the receiving platform 72 to move downwardly in unison for a short distance as indicated in FIG. 6.

The simultaneous downward movement of the press plate 32 and the receiving platform 72 enhances the ability of the apparatus 10 to maintain aligned stacks of labels L. As the labels L are driven through the die openings 41, the press members 34 maintain pressure on the upper portion of the stacks of labels L while the receiving platform 72 exerts pressure on the underside of the stacks of labels L. Since the walls of the die openings 41 and the pressing sheets S themselves confine the stacks of labels L on their sides, the majority of labels L within a stack are completely confined at all times as the labels are being pressed from the pressing sheets S. Accordingly, the labels L emerge from the die openings 41 in tight, aligned stacks.

Referring now to FIG. 3, once the labels L are pressed from all the pressing sheets S, the press plate 32 is caused to reverse direction of movement and the hydraulic motors 52 cause the press plate 32 to rise to its initial position. When the press plate 32 reaches its lowermost position and all the labels L have been pressed from the pressing sheets S, the operator must shift the position of the master control valve 112, as seen in FIG. 7, from the "A" position to the "C" position using the master control handle 84. This causes hydraulic fluid to be routed through hydraulic lines 122 to reverse direction of all hydraulic motors 52, 74. As a result the press plate 32 is returned to its initial, lowered position and the receiving platform 72 is lowered to its initial, raised position.

With reference to FIG. 2, when the receiving platform 72 is at its maximum height adjacent the die plate 40, the conveyor belt 92 is fully extended. The increased tension on the conveyor belt 92 causes the tension roller 96 to be forced outwardly against the springs 98. The resultant spring force as continually applied through the tension roller 96 causes the conveyor belt 92 to maintain tension throughout the rise and subsequent fall of the receiving platform 72.

Referring now to FIG. 3, the descent of the receiving platform 72 causes the conveyor belt 92 to also descend. In order to maintain tension on the conveyor belt 92, the tension roller 96 is maintained in contact with the conveyor belt 92 by action of the tensioning spring 98 on the tension roller support member 100 such that when the conveyor belt 92 becomes loosened, the tensioning spring 98 contracts, maintaining contact at the tension roller 96 with the conveyor belt 92, thereby maintaining tension on the conveyor belt 92.

When the receiving platform 72 is returned to its lowermost position, the conveyor belt 92 is extended horizontally thereacross. Accordingly, the operator is then free to activate the conveyor belt 92 using the motor controller 60, which moves the labels L out onto the auxiliary frame 24 as depicted by the horizontal arrow in FIG. 3. When the labels are moved onto the auxiliary frame 24 they can be removed as a group from the apparatus 10 using the receiving and removal board (not shown) and taken to another area for packaging. The pressing sheets which have the label portions removed are known as "skeletons" and are manually removed from the apparatus 10 and recycled. The apparatus 10 is then ready to accept another stack of pressing sheets S for label removal.

When the apparatus 10 of the present invention is used to press computer disk sleeves formed of TYVEK® fiber sheeting material, a rigid member (not shown) formed in the shape of the "skeletons" is placed on top of the stack of pressing sheets S to hold the pressing sheets S in place during the pressing operation. Due to the slick surface and flexibility of the TYVEK® fiber sheeting material, uneven pressing may result without use of the rigid auxiliary "skeleton."

Since all labels are not the same size, different types of labels will require different sized die openings 41 and different sized press members 34 or will require a different pattern of die openings 41 and press members 34. In that regard and according to one feature of the present invention, the press plate 32 and the die plate 40 are easily removed from the apparatus 10. Once the press plate 32 and die plate 40 are removed, a different press plate 32 and die plate 40 may be inserted having a different configuration of press members 34 and die openings 41. Removal and replacement of the press plate 32 and the die plate 40 may be accomplished as follows.

Generally, and with reference to FIG. 4, the removal and replacement process involves bolting the die plate 32 to the press plate 40 and removing both as a unit using a forklift F. Specifically, the alignment members 44, 45 and the stop members 46 (see FIG. 2) are removed from the die plate 40 leaving a flat support surface 28. The press plate 32 is caused to be lowered onto the die plate 40 with the press members 34 in mating relation with the die openings 41 and the press plate 32 resting on the die plate 40. Holes (not shown) are formed in the press plate 32 to be in alignment with the holes provided for the stop members 46 in the die plate 40. Conventional bolts 62 are utilized through these openings to secure the press plate 32 and the die plate 40 in mating relation. The operator then operates the hydraulic motors 52 to cause the press plate 32 with the die plate 40 thereattached to ascend to a position intermediate the uppermost position and the lowermost position attainable by the press plate 32. A forklift F is positioned to support the press plate 32 with the die plate 40 attached thereto while the alignment rods 36 are unthreaded from the die plate 40 and removed. The rod and pin assembly 58 is then removed from the mounting bar 48 and the C-shaped members 53. Upon removal of the alignment rods 36 and the rod and pin assembly 58, the die plate 32 with the press plate 40 attached thereto may be removed from the apparatus 10 using the aforementioned forklift F. Another press plate 32 and die plate 40 may be reattached by reversing the order of operations previously described.

Figure 8:
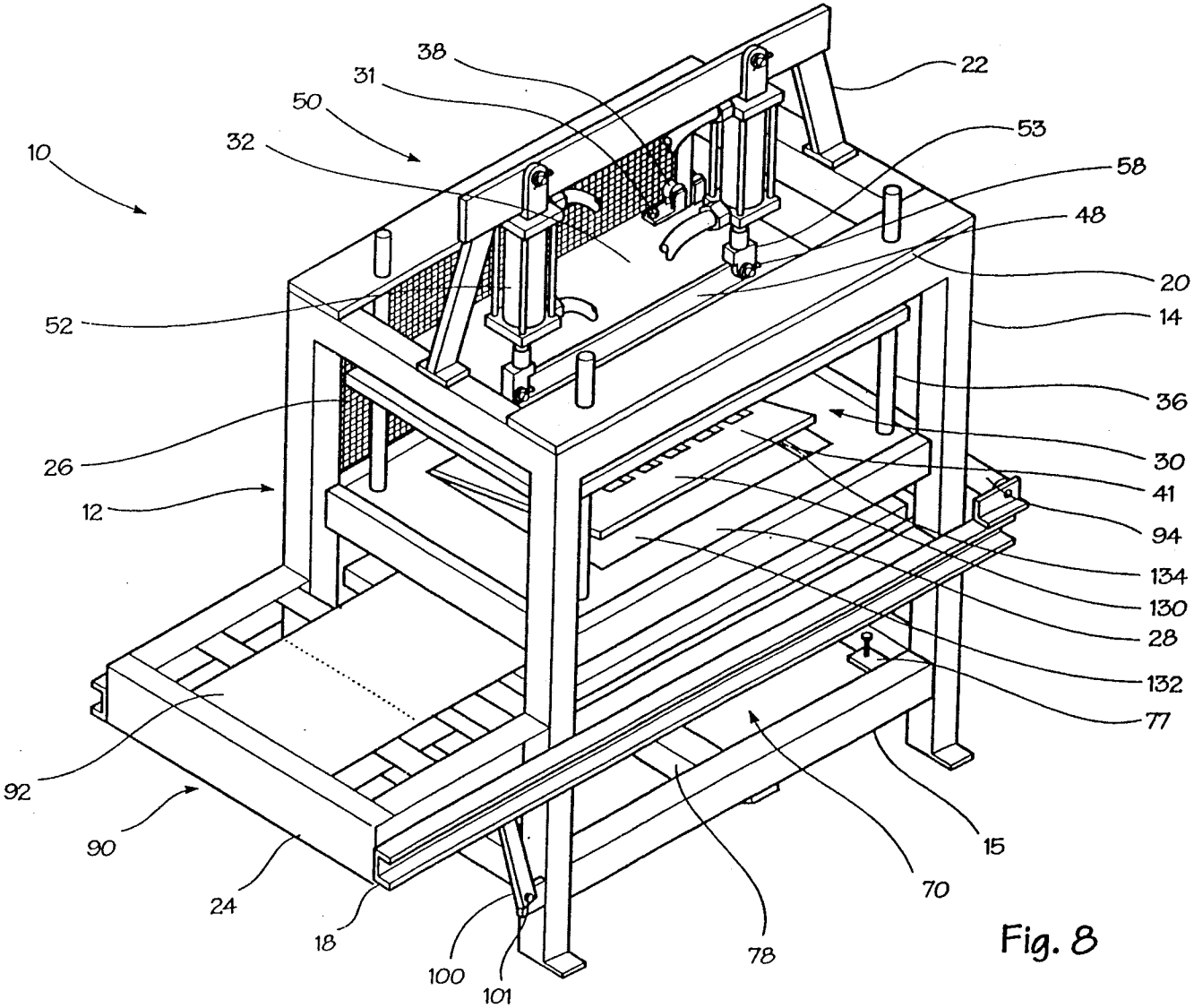
FIG. 8 is a perspective view of the present invention illustrating an alternate method of removing the die plate.

In an alternate embodiment of the present invention, the die plate 40 is attached to the apparatus 10 differently than previously described. With reference to FIG. 8, an opening 132 larger than the perimeter dimension of the predetermined label pattern is formed in the die plate support surface 28 with a lip 134 extending inwardly around the perimeter of the opening 132. A removable die plate 130 is formed to fit within the opening 132. Accordingly, to change the press and die assembly, the removable die plate 130 is lifted out of its opening 132, preferably by two people, and another removable die plate 130 with the desired pattern of die openings 41 is placed within the opening 132 with the removable die plate 130 resting on the lip 134 provided in the opening 132. The removable die plate 130 is light enough that two people can maneuver it into position in the apparatus 10. The press plate 32 is then interchanged using the method previously described. This alternative feature of the present invention provides a faster method for changing the configuration of the label removal apparatus 10 to accommodate different patterns of labels.

As can be seen from the foregoing, the present invention provides a rapid, safe method of removal of a plurality of labels from a plurality of stacked pressing sheets. Further, the present invention provides an improved method of removal of labels from a plurality of pressing sheets as well as the ability to readily change configurations to adapt to any label pattern within a pressing sheet.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. An apparatus for removing a plurality of paper sheet portions from the plurality of pressing sheets, the sheet portions being arranged in a predetermined pattern in the pressing sheets, said apparatus comprising:

(a) a frame;

(b) means for pressing the sheet portions from the pressing sheets including a press slate slidably mounted to said frame and having a plurality of press members for pressing the sheet portions from the pressing sheets;

(c) means for simultaneously receiving and aligning the plurality of sheet portions pressed from the pressing sheets into a stack including a die plate mounted to said frame in a spaced relation with said press plate, said die plate having a plurality of openings formed therein for passage therethrough of the sheet portions and a receiving plate movably mounted to said frame spaced from said die plate and positioned for receiving stacks of aligned sheet portions removed from the pressing sheets by said press members after the sheet portions pass through said openings in said die plate and means for moving said receiving plate along a predetermined path between a first position adjacent said die plate for receiving the sheet portions and a second position in which said receiving plate is spaced away from said die plate for removal of the sheet portions, said receiving plate moving means including pressurized piston and cylinder means mounted to said frame intermediate said receiving plate and said frame thereby allowing said receiving plate to move along its path;

(d) means for removing said stack of aligned plurality of sheet portions from said receiving and aligning means; and (e) control means for directing the operation of said pressing means and said removing means in a predetermined sequence by releasing pressure from said piston and cylinder means responsive to movement of said press plate, said control means including a sequencing valve.

2. An apparatus for removing a plurality of paper sheet portions from a plurality of pressing sheets, the sheet portions being arranged in a predetermined pattern in the pressing sheets, wherein said apparatus includes a frame, said removal apparatus comprising:

(a) a press plate slidably mounted to said frame and having a plurality of press members for pressing the sheet portions and thereby removing the sheet portions from the pressing sheets, said press members projecting from said press plate and arranged in a predetermined pattern corresponding generally to the predetermined pattern of the sheet portions in the pressing sheets;

(b) a die plate mounted to said frame in a spaced relation with said press plate, said die plate having a support surface formed with a plurality of openings therein, said openings being of a shape generally conforming to the shape of the sheet portions in the pressing sheets, whereby the pressing sheets can be stacked on said support surface intermediate said die plate and said press plate with the sheet portions aligned with said openings, said openings being of a depth at least equal to the height of said stacked pressing sheets;

(c) means for moving said press plate along a path of movement between a first position at which said press members are spaced away from said die plate support surface and a second position at which said press members are adjacent said openings formed in said die plate support surface so that when the pressing sheets are positioned on the die plate support surface, the press members engage the sheet portions for pressing the sheet portions to remove them from the pressing sheets and into said openings; and (d) receiving and collecting means positions for receiving the sheet portions from said openings in said support surface as aligned stacks and for collecting said stacked sheet portions including a receiving plate mounted on said frame beyond said die plate and positioned for receiving stacks of aligned sheet portions removed from the pressing sheets and further including means for moving said receiving plate responsive to movement of said press plate along a predetermined path between a first position adjacent said die plate for receiving the sheet portions as they are removed from said openings in said die plate support surface and a second position in which said receiving plate is spaced away from said die plate for removal of the sheet portions from said receiving plate, said receiving plate moving means including pressurized piston and cylinder means mounted to said frame intermediate said receiving plate and said frame thereby allowing said receiving plate to move along its predetermined path; and (e) control means for initiating movement of said receiving and collecting means responsive to movement of said press plate, said control means including a sequencing valve.

* * * * *